US009622575B2

(12) United States Patent
Vickary

(10) Patent No.: US 9,622,575 B2
(45) Date of Patent: Apr. 18, 2017

(54) STORAGE CABINET HAVING A LOCKING BAR AND METHOD FOR SECURING THE SAME

(71) Applicant: AMERICAN STANDARD MANUFACTURING, INC., Central Bridge, NY (US)

(72) Inventor: C. Dominic E. Vickary, Cobleskill, NY (US)

(73) Assignee: AMERICAN STANDARD MANUFACTURING, INC., Central Bridge, NY (US)

( * ) Notice: Subject to any disclaimer, the term of this patent is extended or adjusted under 35 U.S.C. 154(b) by 91 days.

(21) Appl. No.: 14/533,767

(22) Filed: Nov. 5, 2014

(65) Prior Publication Data

US 2015/0123529 A1 May 7, 2015

Related U.S. Application Data

(60) Provisional application No. 61/900,132, filed on Nov. 5, 2013.

(51) Int. Cl.

| | |
|---|---|
| ***E05C 19/08*** | (2006.01) |
| ***A47B 81/00*** | (2006.01) |
| ***A47B 55/00*** | (2006.01) |
| ***E05C 19/00*** | (2006.01) |
| ***E05B 63/00*** | (2006.01) |

(52) U.S. Cl.

CPC ..... *A47B 55/00* (2013.01); *E05B 63/0052* (2013.01); *E05C 19/002* (2013.01); *E05C 19/003* (2013.01); *A47B 81/007* (2013.01); *E05C 19/00* (2013.01); *Y10T 292/323* (2015.04)

(58) Field of Classification Search

CPC ..... E05B 57/00; E05B 65/467; E05B 65/462; E05B 65/46; E05B 77/44; E05B 65/0025; E05B 63/0052; E05C 19/001; E05C 19/002; E05C 19/006; E05C 19/00; E05C 19/08; E05C 19/003; A47B 63/00; A47B 81/007; A47B 55/00; A47K 5/02

USPC ..... 312/107.5, 215–222, 324, 326; 292/285; 109/52

See application file for complete search history.

(56) References Cited

U.S. PATENT DOCUMENTS

| | | | | |
|---|---|---|---|---|
| 490,099 | A * | 1/1893 | Bloomfield | 312/216 |
| 1,678,736 | A * | 7/1928 | Ledin | E05B 65/467 312/216 |
| 1,806,772 | A | 5/1931 | Wasberg et al. | |
| 2,803,512 | A * | 8/1957 | Band | 312/298 |
| 2,913,296 | A | 11/1959 | Martin | |
| 3,000,535 | A | 9/1961 | Erdmann | |
| 3,002,800 | A | 10/1961 | McMahan | |

(Continued)

*Primary Examiner* — Daniel J Troy
*Assistant Examiner* — Ryan A Doyle
(74) *Attorney, Agent, or Firm* — Schmeiser, Olsen & Watts, LLP

(57) ABSTRACT

A storage propane tank storage cabinet including a frame, a door operably attached to the frame, and a locking bar operably attached to the frame, the locking bar configured to move from a first position to a second position, wherein, when in the second position, the locking bar covers a portion of the door proximate a top corner of the door and proximate a bottom corner of the door to prevent unauthorized access to an interior of the frame is provided. Furthermore, an associated method is also provided.

11 Claims, 4 Drawing Sheets

(56) References Cited

U.S. PATENT DOCUMENTS

| | | | | | |
|---|---|---|---|---|---|
| 3,146,739 | A | * | 9/1964 | Furman | A47B 63/00 109/52 |
| 3,189,392 | A | * | 6/1965 | Mehlig, Jr. et al. | 312/216 |
| 3,572,796 | A | * | 3/1971 | Willner | E05C 19/08 292/205 |
| D230,446 | S | * | 2/1974 | Price | D6/657 |
| 3,856,373 | A | * | 12/1974 | Tucich | E05B 65/467 292/259 R |
| 3,893,740 | A | | 7/1975 | England | |
| 4,384,428 | A | * | 5/1983 | Cox | E05B 65/1033 49/56 |
| 4,509,805 | A | * | 4/1985 | Welsch et al. | 312/210 |
| D283,182 | S | * | 4/1986 | Marshall | D30/108 |
| 4,660,902 | A | * | 4/1987 | Resendez, Jr. | E05C 19/08 312/114 |
| 5,562,316 | A | | 10/1996 | Bullock et al. | |
| 5,683,126 | A | | 11/1997 | DeVivo et al. | |
| 6,520,405 | B1 | * | 2/2003 | Braxter | A47G 29/1209 232/45 |
| D485,450 | S | * | 1/2004 | Smith | D6/657 |
| 6,854,775 | B2 | | 2/2005 | Senn | |
| 8,146,205 | B2 | | 4/2012 | Conner et al. | |
| 2004/0103598 | A1 | * | 6/2004 | Marler et al. | 52/106 |
| 2007/0205703 | A1 | * | 9/2007 | McLuckie et al. | 312/216 |
| 2009/0250950 | A1 | | 10/2009 | Jeffries | |
| 2010/0026147 | A1 | * | 2/2010 | Mackillop | 312/215 |
| 2012/0194044 | A1 | * | 8/2012 | Niedzwiecki | 312/215 |
| 2014/0217139 | A1 | * | 8/2014 | Bonenberger | B60R 9/065 224/274 |

* cited by examiner

STORAGE CABINET HAVING A LOCKING BAR AND METHOD FOR SECURING THE SAME

CROSS-REFERENCE TO RELATED APPLICATIONS

This application claims priority to U.S. Provisional Application No. 61/900,132, filed Nov. 5, 2013, and entitled "Storage Cabinet Having a Locking Bar," the entire contents of which are hereby incorporated by reference.

FIELD OF TECHNOLOGY

The following relates to a locking mechanism for a cabinet, and more specifically to embodiments of a storage cabinet having a locking bar to hinder access to an interior of the storage cabinet, and a method for securing the same.

BACKGROUND

Pressurized containers, such as propane tanks, require safe storage. Typical safe storage of propane tanks involves storing the propane tanks outside and away from heat sources. Major retailers of propane tanks typically store propane tanks in a cabinet located outside of the building. In addition to storing the propane tanks outside, the cabinet door is usually only secured with a conventional lock, such as a combination lock or padlock, to prevent unauthorized access. The conventional lock is placed at a handle location to secure against the openings of the cage door. Because the conventional lock is located at a single location, such as by the handle or a center location of the cabinet, the corners of the cabinet door are vulnerable to tampering to obtain access to the interior of the cage. For example, vandals may use a crowbar or similar tool to pry back the corners of the cabinet door just enough to reach in the interior of the cabinet and grab a propane tank, bypassing the conventional lock. This leaves the storage cabinet destroyed and the retailer and/or manufacturer at a loss due to a stolen propane tank.

Thus, a need exists for an apparatus and method for locking a storage cabinet that eliminates the vulnerability to the corners of the cabinet door to protect the contents located within the storage cabinet.

SUMMARY

A first aspect relates generally to storage cabinet having a locking bar to prevent unauthorized access to the interior of the storage cabinet.

A second aspect relates generally to a storage cabinet comprising a frame, a door operably attached to the frame, and a locking bar operably attached to the frame, the locking bar configured to move from an unlocked position to a locked position, wherein, when in the locked position, the locking bar covers a portion of the door proximate a top corner of the door and proximate a bottom corner of the door to prevent unauthorized access to an interior of the frame.

A third aspect relates generally to a method of securing contents within a storage cabinet comprising providing the storage cabinet that may be configured to store one or more cylinders, operably attaching a door that may substantially enclose an interior of the storage cabinet, and operably attaching a locking bar to the storage cabinet, wherein the locking bar may be hingedly moved from an unlocked position to a locked position.

A fourth aspect relates generally to a propane tank storage cabinet comprising a frame, a door operably attached to the frame, and a locking bar operably attached to the frame, the locking bar configured to move from a first position to a second position, wherein, when in the second position, the locking bar covers a portion of the door proximate a top corner of the door and proximate a bottom corner of the door to prevent unauthorized access to an interior of the frame.

A fifth aspect relates generally to a cage for storing gas containing tanks comprising a metallic frame with a plurality of openings that provide visual access to an interior of the metallic frame, the interior of the metallic frame configured to house one or more gas containing tanks, the metallic frame including a first forward facing surface and a second forward facing surface, a pivotable door operably attached to the metallic frame for hindering access to the interior of the metallic frame when in a closed position, the door having a top corner portion, a bottom corner portion, and an edge, and a locking bar operably attached to the metallic frame, the locking bar having a first surface and a second surface, wherein, the first surface of the locking bar engages the edge of the pivotable door and the second surface engages the top corner and the bottom corner of the pivotable door when the pivotable door is in the closed position and the locking bar is in a locking position.

A sixth aspect relates generally to a method of securely storing gas-containing tanks comprising providing a metallic frame with a plurality of openings that provide visual access to an interior of the metallic frame, the interior of the metallic frame configured to house one or more gas containing tanks, the metallic frame including a first forward facing surface and a second forward facing surface, operably attaching a pivotable door to the metallic frame for hindering access to the interior of the metallic frame when in a closed position, the door having a top corner portion, a bottom corner portion, and an edge, and operably attaching a locking bar to the metallic frame, the locking bar having a first surface and a second surface, wherein, the first surface of the locking bar engages the edge of the pivotable door and the second surface of the locking bar engages the top corner and the bottom corner of the pivotable door when the pivotable door is in the closed position and the locking bar is in a locking position.

The foregoing and other features of construction and operation will be more readily understood and fully appreciated from the following detailed disclosure, taken in conjunction with accompanying drawings.

BRIEF DESCRIPTION OF THE DRAWINGS

Some of the embodiments will be described in detail, with reference to the following figures, wherein like designations denote like members, wherein.

DETAILED DESCRIPTION

A detailed description of the hereinafter described embodiments of the disclosed apparatus and method are presented herein by way of exemplification and not limitation with reference to the Figures. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

Figure 1:
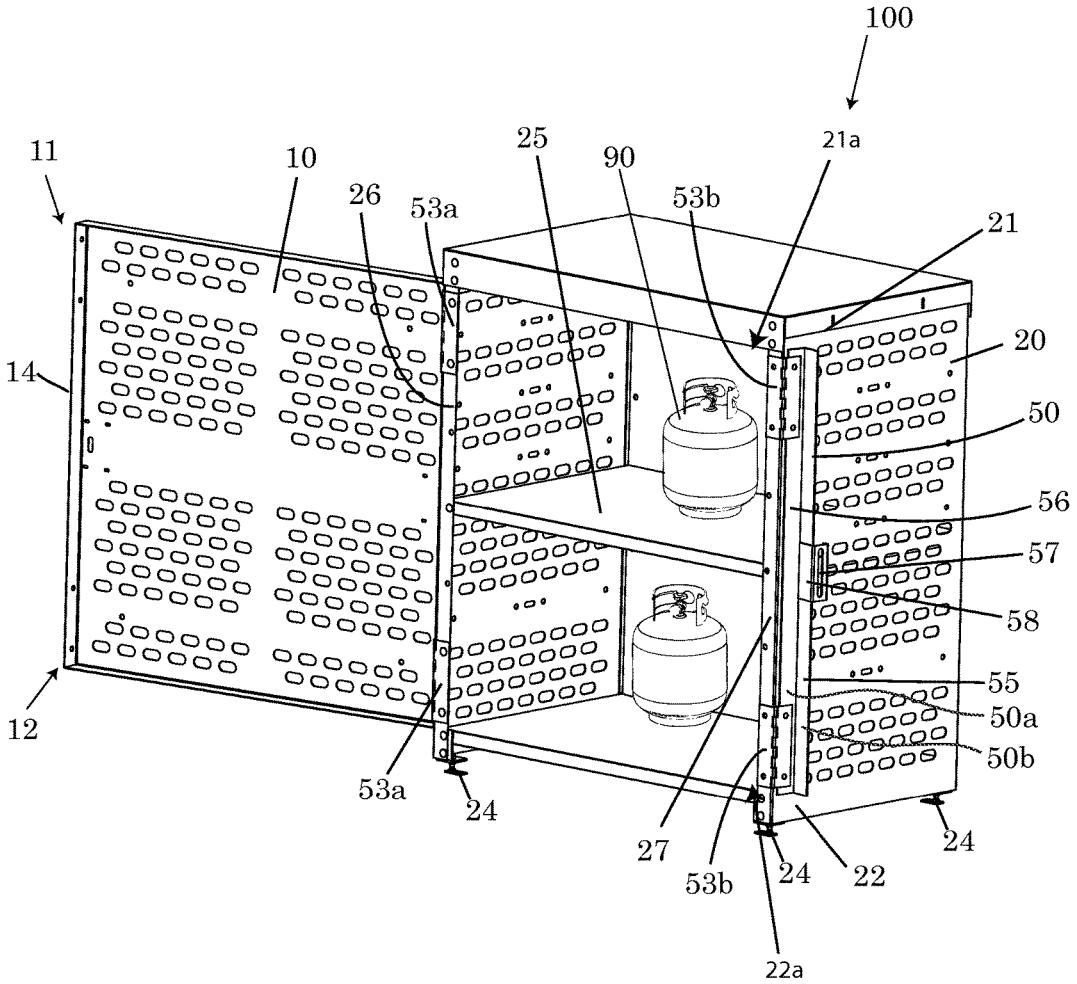
FIG. 1 depicts a perspective view of an embodiment of a storage cabinet in an open position.

Referring to the drawings, FIG. 1 depicts an embodiment of a storage cabinet 100. Embodiments of a storage cabinet 100 may be a cabinet, a cage, a display, a storage cabinet, a cylinder exchange display, a pressure cylinder storage unit, a merchandising display cabinet, and the like. Embodiments of the storage cabinet 100 may house, retain, display, contain, store, receive, etc., one or more cylinders 90. Embodiments of the cylinders 90 may be shaped other than a cylinder, and may have a cross-section that is polygonal and/or curvilinear. For instance, embodiments of the storage cabinet 100 may store one or more cylinders 90 in an outdoor or indoor location. Embodiments of cylinder 90 may be a tank, a gas storage container, a vessel, a container, a propane tank, a gas cylinder, a low-pressure gas cylinder, a high-pressure gas cylinder, a propane motor-fuel cylinder, and the like. In further embodiments, the storage cabinet 100 may store contents unrelated to gas storing cylinders. For example, embodiments of the storage cabinet 100 may safely and securely store and contain any merchandise, goods, personal belongings, power and lawn equipment, and the like.

Embodiments of the storage cabinet 100 may include a frame 20, a door 10, and a locking bar 50. Embodiments of the storage cabinet 100 may include a frame 20, a door 10 operably attached to the frame 20, and a locking bar 50 operably attached to the frame 20, the locking bar configured to move from an unlocked position to a locked position, wherein, when in the locked position, the locking bar may cover a portion of the door from a top corner of the door to a bottom corner of the door to prevent unauthorized access to an interior of the frame.

Referring still to FIG. 1, embodiments of the storage cabinet 100 may include a frame 20. Embodiments of the frame 20 may be referred to as a body, a cage body, a cabinet body, and the like. The frame 20 may protect the cylinders 90 located within an interior of the cabinet 100, and may also form the general structure of the cabinet 100. Embodiments of the frame 20 may be a structure defined by a plurality of walls or portions, such as a right side wall, a left side wall, a bottom portion, a top portion, and a back portion. The bottom portion may be used as a bottom shelf that is bolted or otherwise joined to the right and left side walls, and the back portion and top portion may be a panel operably fastened or otherwise connected to the left and right side walls to help shield the contents or cylinders 90 located in an interior of the cabinet 100 from environmental elements or vandals. The plurality of walls, panels, or other surfaces forming the general structure of the cabinet 100 may include a plurality of openings, such as slots, holes, vents, and the like. The plurality of openings may both reduce the weight of the frame 20 and provide visual access to the interior of the frame 20. A front of the frame 20 may be open to an environment, exposing and/or making accessible the interior of the cabinet 100, when the door 10 is in an open position. The front of frame 20 may include a first end 21 and a second end 22, on either side of the frame 20. In some embodiments, the area proximate or at the first end 21 may define a top corner 21*a* of the frame 20, and the area proximate or at the second end 22 may define a bottom corner 22*a* of the frame 20. The corners 21*a*, 22*a* may be located on either side of the frame 20, respectively, and may be part of the frame 20 where two portions of the frame 20 converge, or otherwise connect, may define an area or opening providing access to the interior of the frame 20 proximate the upper and lower corners of the front of the frame 20, or may define a combination of both the frame 20 and the area proximate the corners. The side of the frame 20 that the corners 21*a*, 22*a* are located may depend on the orientation of the door 10 with respect to the frame 20 (i.e. which way the door 10 swings open). Moreover, embodiments of the corners 21*a*, 22*a* may be access points or weak points in a conventional cabinet, wherein part of the frame or door can be peeled back. Embodiments of the storage cabinet 100, with the locking bar 50, can eliminate or at least protect those weak points in the storage cabinet.

Embodiments of the frame 20 may further include a first forward facing edge 26 and a second forward facing edge 27. Embodiments of the first forward facing edge 26 and the second forward facing edge 27 may be a surface of the frame 20 that may accept, accommodate, receive, etc., one or more mechanical pivoting devices, such as hinges 53*a*, 53*b*. Embodiments of the first forward facing edge 26 may be configured to facilitate attachment of the door 10 of the cabinet 100 to the frame 20 through operation of hinges 53*a*. Embodiments of the second forward facing edge 27 may be configured to facilitate attachment of the locking bar 50 to the frame 20 through operation of hinges 53*b*. Embodiments of the second forward facing edge 27 may also be configured to physically engage an inner portion of the door 10 when the door 10 is in a closed position. The door 10 may also close such that door 10 covers the interior of the frame 20, but does not engage the forward facing edge 27; the door 10 may abut or reside contiguous with the forward facing surface 27. In addition, embodiments of the first forward facing edge 26 and the second forward facing edge 27 may extend between first end 21 and the second end 22 of the frame 20.

Furthermore, the frame 20 may be comprised of a metal and/or a combination of metals, such as steel, iron, or the like, and/or may be coated, plated, painted or galvanized for weather resistance. In one embodiment, the frame 20 may be made of aluminum. Embodiments of the frame 20 may be a welded frame, or a frame assembled through utilization of a plurality of fasteners. Construction of the frame 20 may be accomplished using materials and techniques known to those having ordinary skill. The frame 20 may be of various sizes, incorporating various dimensions of the length (e.g. height), the width, and the depth. In other words, the storage cabinet 100, in particular, the frame 20 may be sized and dimensioned to store a plurality of cylinders 90. Moreover, embodiments of the storage cabinet 100 may include a shelf 25 that can extend horizontally within the frame 20 to separate the interior of the cabinet 100 into two or more sections. Embodiments of the frame 20 may include more than shelf 25, or no shelf at all, depending on the contents being stored within the cabinet 100 and/or the size of the contents being stored therein. Embodiments of a shelf 25 may accommodate, support, etc., one or more cylinders 90 for efficient storing and displaying of the cylinders 90. Further embodiments of the storage cabinet 100 may include a divider that extends vertically within the frame 20 to separate the interior of the cabinet 100 into two or more sections. Other devices may be utilized inside the cabinet 100 for safe, secure, and organized storage of contents. Furthermore, embodiments of the frame 20 may include one or more feet 24. Embodiments of the feet 24 may be attached to the bottom surface or bottom wall of the frame 20. The feet 24 may be adjustable for leveling the frame 20 when set into place.

With continued reference to FIG. 1, embodiments of the storage cabinet 100 may include a door 10. Embodiments of the door 10 may be operably attached to the frame 20. The door 10 may be moved from an open position (i.e. the interior of the cabinet 100 is accessible through the open front of the frame 20) to a closed position (i.e. the interior of the cabinet 100 is substantially inaccessible through the open front of the frame 20). In one embodiment, the door 10 may be hingedly attached to the frame 20 via hinges 53*a*, thereby allowing the door 10 to swing, pivot, and/or hinge from the open position, as shown in FIG. 1, to the closed position, shown in FIG. 3; the door 10 may also slide (up, down, or across) or slide out like a drawer from an open to a closed position. Embodiments of the storage cabinet 100 may include a single door, but may also include side-by side doors that each hingedly open to expose or provide access to an interior of the cabinet 100, and the contents inside. Moreover, embodiments of the door 10 may have a first end 11 and a second end 12. In some embodiments, the first end 11 may define a top corner 11*a* of the door 10, and the second end 12 may define a bottom corner 12*a* of the door 10. A section of the door 10 on an inner surface of the door adjacent to an edge of the door 10 may be configured to physically engage the second forward facing edge 27 when in the closed position. Embodiments of the door 10 may further include a handle portion 17, shown in FIG. 3. The handle portion 17 may project or protrude from an outer surface 13 of the door 10. The handle portion 17 may facilitate the operability of the door 10 for opening and closing the door 10. At a distal end of the handle portion 17 from the outer surface 13 of the door 10, a lip 18 or flange may be located to facilitate gripping of the door 10 for movement of the door 10. The lip 18 may extend in a direction parallel or substantially parallel to the door 10. The handle portion 17 may be operably connected to the door 10. For example, the handle 17 may be attached to the door 10 through utilization of one or more fasteners, such as metal screws or bolts, or by a welded connection. Other operable connections to of the door handle 17 to the door 10 may include a base plate, such as a metal plate, that can be positioned on the inner surface of the door 10 at the location where the door handle 17 is located, wherein the base plate may have one or more openings that accept one or more fasteners. The fasteners may extend through one or more openings on the door handle 17 and through the openings on the base plate to sandwich the door 10 and further secure the door handle 17 to the door 10. Further, embodiments of the handle portion 17 may include one or more openings to accommodate a portion of a conventional lock, such as lock 80, shown in FIG. 4. The one or more openings on the handle portion 17 may be a single elongated opening, or one or more holes configured to receive a portion of lock 80. Further, the openings on the door handle 17 may align or substantially align with an opening on the locking bar 50.

Embodiments of the door 10 may be sized and dimensioned to cover, substantially cover, or partially cover an opening of the frame 20, or fit within the opening of the frame 20. For example, embodiments of the door 10 may be sized and dimensioned to coincide with the height and width of the opening of the frame 20, wherein a height of the door 10 may extend from the first end 21 and the second end 22 of the frame 20, or slightly beyond the ends 21, 22. Furthermore, the door 10 may be comprised of a metal and/or a combination of metals. In one embodiment, the door 10 may be made of aluminum. Construction of the door 10 may be accomplished using materials and techniques known to those having ordinary skill. Embodiments of the door 10 may include a plurality of openings, such as slots, holes, vents, and the like. Embodiments of the door 10 may be comprised of the same materials as the frame 20.

Figure 2A:
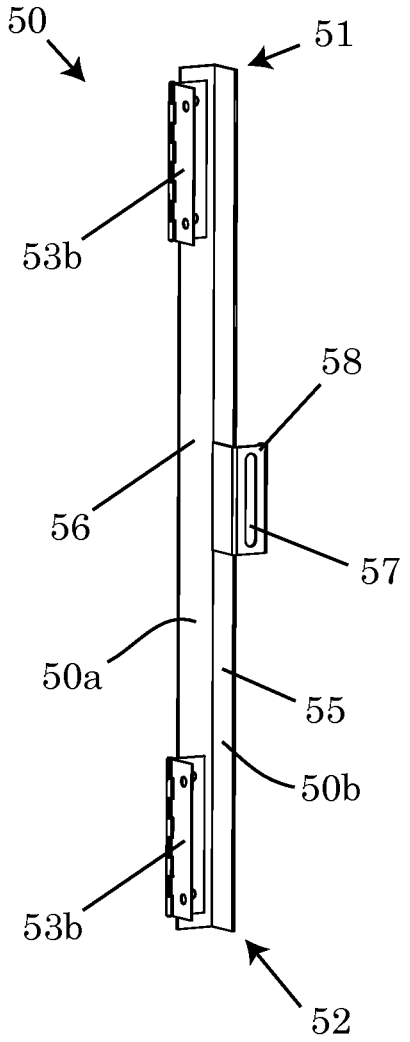
FIG. 2A depicts a perspective view of an embodiment of a locking bar.
Figure 2B:
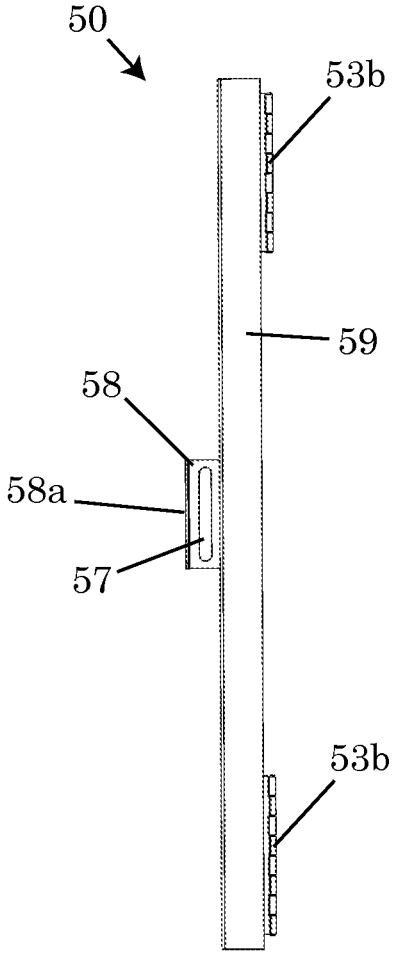
FIG. 2B depicts a side view of an embodiment of the locking bar.
Figure 2C:
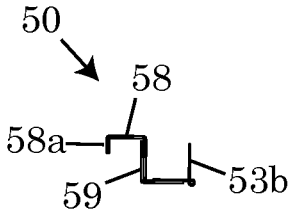
FIG. 2C depicts a top view of an embodiment of the locking bar.
Figure 3:
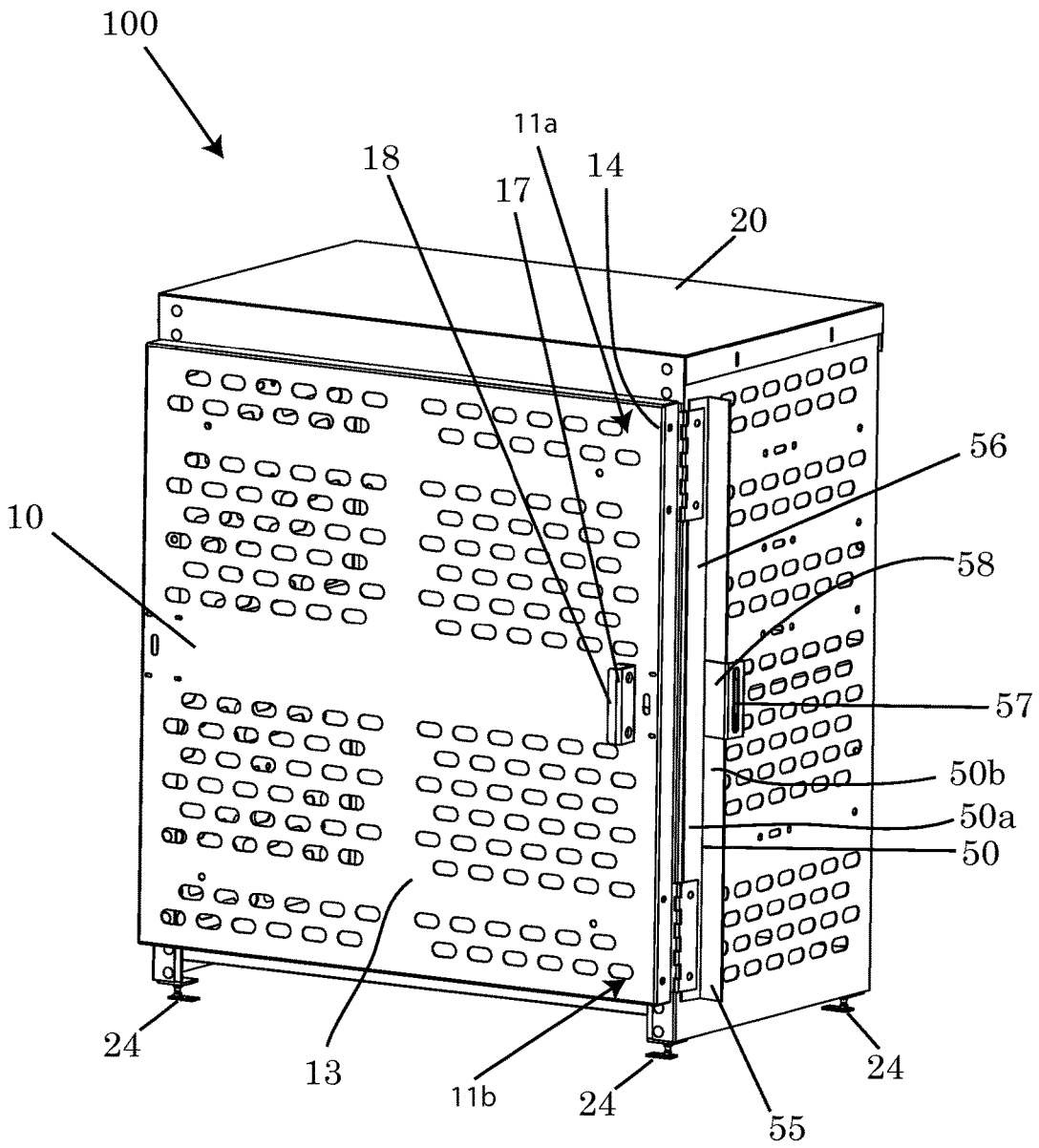
FIG. 3 depicts a perspective view of an embodiment of the storage cabinet in a closed or unlocked position.

Referring still to FIG. 1, and now additional reference to FIGS. 2A-2C, embodiments of the storage cabinet 100 may include a locking bar 50. Embodiments of locking bar 50 may be operably connected to the frame 20. Because embodiments of the frame 20 may be symmetrical (e.g. rights side is the same as the left side), the locking bar 50 may be operably attached to either side of the frame 20. The locking bar 50 may be moved from an unlocked position (i.e. door 10 is free to move from the open position to the closed position) to a locked position (i.e. the locking bar 50 engages the door 10 when the door is in the closed position). In one embodiment, the locking bar 50 may be hingedly attached to the frame 20 via hinges 53*b*, thereby allowing the locking bar 50 to swing, pivot, and/or hinge from the unlocked position relative to the locking bar 50 (or closed position relative to the door 10), as shown in FIG. 3, to a locked position, shown in FIG. 4. Those having skill in the art should appreciate that the hinges 53*b* may be located on either side of the frame 20 for operable attachment of the locking bar 50, and that a single hinge joint may be utilized. Moreover, embodiments of the locking bar 50 may have a first end 51 and a second end 52. While the locking bar 50 is operably connected to the frame 20, the first end 51 of the locking bar 50 may be proximal to the first end 21 of the frame 20, and the second end 52 of the locking bar 50 may be proximal to the second end 22 of the frame 20. Embodiments of the hinges 53*b* may be positioned proximate or otherwise near the first end 51 and the second end 52 of the locking bar 50. Embodiments of the locking bar 50 may be formed of metal or a combination of metals, such as structural steel, angle iron, and/or prefabricated composites, plastics, and the like, or a combination thereof.

Furthermore, embodiments of the locking bar 50 may include a first body portion 50*a* and a second body portion 50*b*. The first body portion 50*a* may be structurally integral with the second body portion 50*b*, and the first body portion 50*a* may be perpendicular or substantially perpendicular to the second body portion 50*b*. In an alternative embodiment, the second body portion 50*b* may be welded or otherwise attached to the first body portion 50*a* to form the locking bar 50. In other words, the locking bar 50 may have a right angle configuration, which may accommodate for a thickness of the door 10 of the cabinet 100 so that the locking bar 50, or a portion thereof, may be flush or substantially flush with the outer surface 13 of the door 10 when in the locked position. Alternatively, embodiments of the locking bar 50 may be a flat member, configured to hinge over and cover a gap between a door 10 and a frame 20, wherein the door 10 and the frame 20 are flush with each other. Embodiments of the locking bar 50 may include a surface 56 that may engage a side of the door 10 adjacent edge 14, wherein the surface 56 may be a surface, such as an inner surface, of the first body portion 50*a* of the locking bar 50. A width or thickness of the surface 56 may be determined by a thickness of the door 10 operably attached to the frame 20. Moreover, embodiments of the locking bar 50 may include a door engagement surface 55, wherein the door engagement surface 55 can be a surface, such as an inner surface, of the second body portion 50*b* of the locking bar 50. Surface 59 may be located on an outer surface of the second body portion 50*b*, opposite the door engagement surface 55. The door engagement surface 55 may be configured to physically mechanically engage, touch, reside against, abut, etc., an outer surface 13 of the door 10 when in the locked position. For example, the door engagement surface 55 may make contact with a portion of the door 10 on the outer surface 13 that is at, proximate, or otherwise near an edge 14 of the door 10. The portion of the door 10 adjacent the edge 14 that may be engaged by the door engagement surface 55 when in the locked position may extend from the first end 11 to the second end 12 of the door, and may extend laterally across the door 10 equal to a width of the second body portion 50*b* of the locking bar 50. Accordingly, in the locked position, embodiments of the locking bar 50 may engage the door 10 from a bottom corner to a top corner to reinforce the corners of the door 10, helping prevent tampering by prying back a corner of the door 10. Embodiments of the locking bar 50 may engage the door 10 proximate the bottom corner of the door and proximate the top corner of the door in the locked position. Further, embodiments of the door engagement surface 55 of the second body portion 50*b* may engage a portion of the frame 20 in embodiments where the door 10 closes within the opening of the front of the frame 20; the frame 20 and the door 10 may be flush with each other. In this embodiment, the locking bar 50 may cover any gap or slight opening that may exist between the frame 20 and the door 10, the coverage of which may extend from the top corner to the bottom corner of the door 10 or the frame 20.

Figure 4:
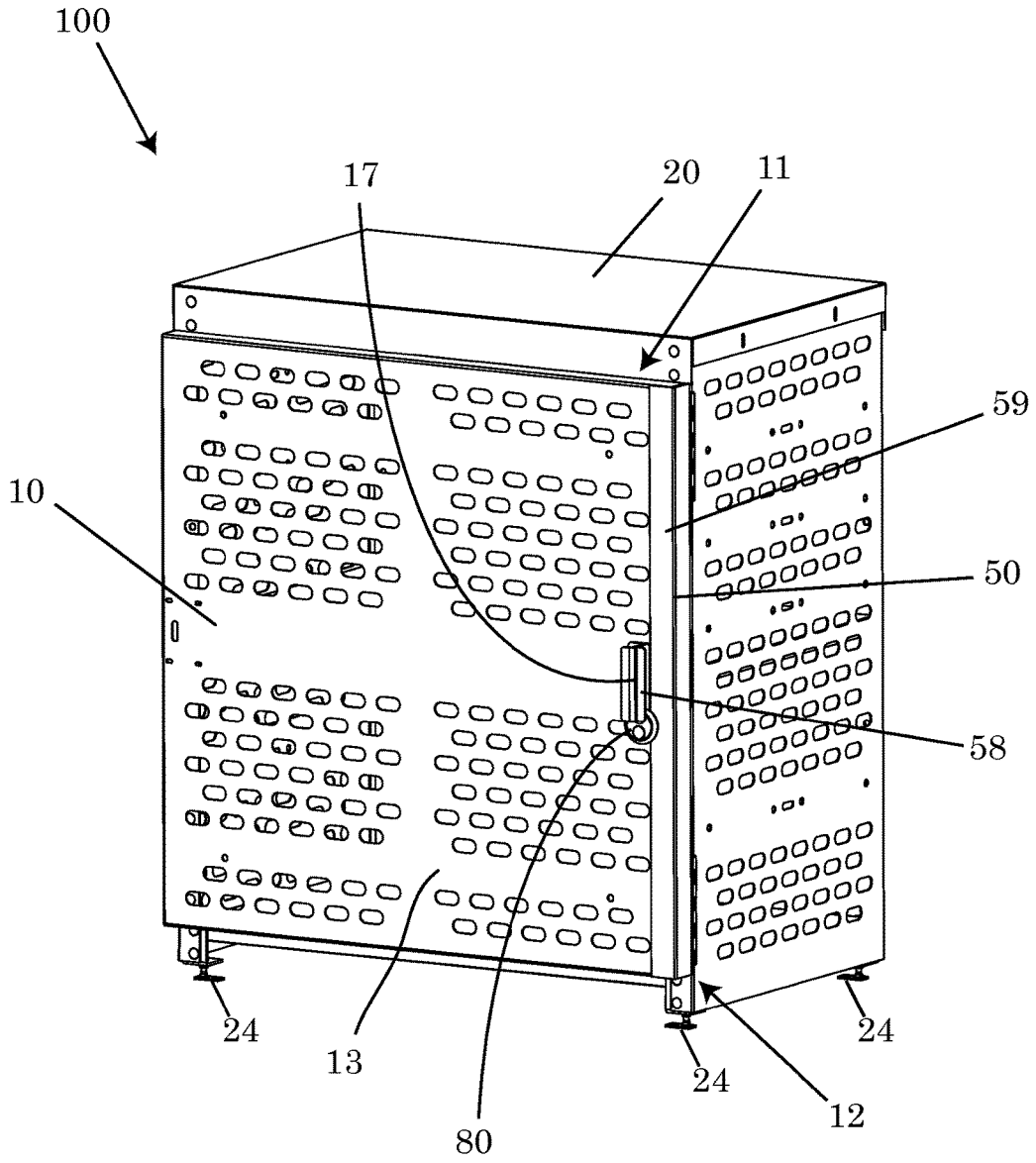
FIG. 4 depicts a perspective view of an embodiment of the storage cabinet in a locked position.

Additionally, embodiments of the locking bar 50 may include a locking bar handle portion 58. Embodiments of the locking bar handle portion 58 may be a handle, a handle portion, a gripper, and the like, attached to or integral with the locking bar 50. For example, the locking bar handle portion 58 may be attached to the locking bar 50 through utilization of one or more fasteners, such as metal screws or bolts, or by a welded connection. In one embodiment, the locking bar handle portion 58 may be attached directly to surface 55 of the first body portion 50*a* of the locking bar 50. Embodiments of the locking bar handle portion 58 may be located between the first end 51 and the second end 52 of the locking bar 50. In some embodiments, the locking bar handle portion 58 may be located at a midpoint, or proximate a midpoint, between the first end 51 and the second end 52 of the locking bar 50. Moreover, embodiments of the locking bar handle portion 58 may include an opening 57 configured to receive a portion of a lock 80. Lock 80, or a portion thereof, may pass through the opening 57 of the locking bar handle 58 and through one or more openings on the handle portion 17 when the storage cabinet 100 is in the locked position, as shown in FIG. 4. For instance, the handle portion 58, when the locking bar 50 is moved from an unlocked position to the locking position, may abut, press against, reside next to or near, the handle portion 17 of the door 10. When positioned side-by-side, the opening 57 of the locking bar handle 58 and one or more openings on the handle portion 17 of the door 10 may align or substantially align to allow a portion of lock 80 to pass therethrough. The presence of a portion of the lock 80 may prevent, hinder, or restrict the locking bar handle 58 and the handle portion embodiments of the opening 57 from moving away from each other. Embodiments of the locking bar handle portion 58 may also include a lip 58*a* that may protrude from the locking bar handle portion 58. The lip 58*a* may protrude from the handle 58 to facilitate gripping of the locking bar handle 58, and ultimately the locking bar 50. When in the locked position, the lip 58*a* may protrude in a direction opposite the direction of the lip 18 of the handle 17.

In alternative embodiments, the opening 57 of the locking bar 50 may be configured to receive the handle portion 17 of the door when the storage cabinet 100 is in the locked position. For instance, embodiments of the opening 57 may correspond to the size and shape of the handle portion 17 so that the handle portion 17, including the lip 18 of the handle portion 17, may fit through the opening 57 when the locking bar 50 is moved over the door 10 to lock the storage cabinet 100. Embodiments of the locking bar handle portion 58 may also include a lip 58*a* that may protrude from the locking bar handle portion 58. The lip 58*a* may protrude from the handle 58 to facilitate mechanical engagement with the lip 18 of the door handle 17, if the door 10 is opened prior to properly, sufficiently, and/or fully removing the locking bar 50 from the locked position. For example, if the door 10 is pulled open in a direction away from the frame 20 prior to swinging the locking bar 50 in an opposite direction from the door (e.g. back to the unlocked position), the lip 18 of the handle portion 17 may physically mechanically engage the lip 58*a* of the locking bar handle portion 58. The engagement between the lip 18 and lip 58*a* may further aid in the hindering of the opening of the door 10

With reference now to FIGS. 1 and 3-4, the manner in which the storage cabinet 100 may be locked will now be described. FIG. 1 depicts an embodiment of the storage cabinet 100 in an open position. In the open position, the door 10 of the cabinet 100 is swung or otherwise positioned away from the frame 20, and the interior of the cabinet 100 is accessible. Cylinders 90 may be loaded and unloaded in this position. FIG. 3 depicts an embodiment of the storage cabinet 100 in a closed position; the closed position may also be referred to as an unlocked position with respect to the locking bar 50. In the closed position, the door 10 may be closed, such that a portion of the door 10 near edge 14 makes physical contact with, or is physically near, the second forward facing surface 27 of the frame 20. The door 10, while covering, or substantially covering, an opening of the frame 20, may be freely moved back and forth to expose and cover the contents within the interior of the storage cabinet 100. FIG. 4 depicts an embodiment of the storage cabinet 100 in a locked position. The locked position may be achieved by first closing the door 10 against the frame 20, and then moving, pivoting, swinging, rotating, etc., the locking bar 50 towards the door 10 of the cabinet 100. The door engagement surface 55 of the second body portion 50*b* of the locking bar 50 may directly engage or nearly engage a face or outer surface 13 of the door 10 along a longitudinal portion of the door 10 that can extend from a first end 11 to the second end 12 of the door 10. Thus, the locking bar 50 provides a mechanical retention of the door 10 in a closed position. For instance, when the locking bar handle portion 58 resides next to the handle portion 17 of the door 10, the openings or slots of the handle 17, 58 may be configured to align to facilitate passage of a portion of a removable lock 80. The lock 80 may hinder, stop, prevent, reduce, etc., a movement of the locking bar 50 away from the door 10 because the locking bar 50 may need to be removed away from the door 10 before the door 10 can be opened, the storage cabinet 100 is in a locked position.

In alternative embodiments, the mechanical retention may be created when the locking bar handle portion 58 fits over the handle portion 17 of the door 10 through the opening 57 of the locking bar handle 58, creating an opening therebetween. The opening or space between handle portions 17, 58 may allow passage of a portion of a removable lock 80. The lock 80 may hinder, stop, prevent, reduce, etc., a movement of the locking bar 50 away from the door 10. Because the locking bar 50 may need to be removed away from the door 10 before the door 10 can be opened, the storage cabinet 100 is in a locked position.

In addition to the mechanical retention of the door 10 against the frame 20, embodiments of the locking bar 10 may cover a gap that may exist between the frame 20 and the door 10 proximate edge 14, extending longitudinally from the first end 11 and the second end 12 of the door 12, when the door 10 is closed. This gap may be exploited to force a tool or other device into the interior of the cabinet 100 to create leverage when prying away a corner of the door 10. Therefore, embodiments of the locking bar 50 may extend from the top corner to the bottom corner of the door to cover a potential gap, and eliminate an entry point for a tool other device that may be used to force entry into the storage cabinet 100. Further, the locking bar 50 may cover the gap proximate the corners of the door 10.

Referring to FIGS. 1-4, a method of locking a storage cabinet 100 may include the steps of providing a storage cabinet 100 that may be configured to store one or more cylinders 90, operably attaching a door 10 that may substantially enclose an interior of the storage cabinet 100, and operably attaching a locking bar to the storage cabinet 100, wherein the locking bar 50 may be hingedly moved from an unlocked position to a locked position. In the locked position, the locking bar may extend from a top corner of the door 10 to a bottom corner of the door 10, and cover a gap occurring at an abutment between the door 10 and the frame 20.

Alternative embodiments of the cabinet 100 may include a locking bar 50 proximate the top corner of the cabinet 100 and a locking bar 50 proximate a bottom corner of the cabinet 100, wherein each locking bar 50 is separate and distinct from the other, and does not extend the entire distance between the first end 21 and the second end 22 of the frame. In other words, a cabinet that includes two locking bars 50 may only be configured to reinforce the corners of the cabinet While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the invention, as required by the following claims. The claims provide the scope of the coverage of the invention and should not be limited to the specific examples provided herein.

What is claimed is:

1. A cage for storing gas containing tanks comprising:

a metallic frame having a first side wall, a second side wall, a top wall, and a bottom wall each being fixed together to form a solid metallic frame, the metallic frame including a plurality of openings that provide visual access to an interior of the metallic frame, the interior of the metallic frame configured to house one or more gas containing tanks, the metallic frame including a first forward facing surface at a first side of the metallic frame and being adjacent to the first side wall, and a second forward facing surface at a second side of the metallic frame and being adjacent to the second side wall;

a pivotable door operably attached to the metallic frame proximate the first side of the metallic frame, the pivotable door engaging the first forward facing surface and the second forward facing surface when in a closed position, the pivotable door having a top corner portion, a bottom corner portion, and an edge surface, the edge surface of the pivotable door being proximate to the second forward facing surface of the metallic frame; and a locking bar operably attached to the metallic frame proximate the second side of the metallic frame, the locking bar having a first body portion substantially perpendicular to a second body portion, the first body portion having a first surface and the second body portion having a second surface, the first surface having a width corresponding to a thickness of the pivotable door, the locking bar including a locking handle portion, wherein the locking handle portion cooperates with a handle of the pivotable door to lock the locking bar in a locking position;

wherein, the first surface of the locking bar covers the edge surface of the pivotable door when the pivotable door is in the closed position, and the second surface at least one of covers and engages the top corner portion and the bottom corner portion of the pivotable door when the pivotable door is in the closed position and the locking bar is in the locking position.

2. The cage of claim 1, wherein the pivotable door is attached to the metallic frame by one or more hinges located on the first forward facing surface of the metallic frame.

3. The cage of claim 1, wherein the locking bar is attached to the metallic frame by one or more hinges located on the second forward facing surface of the metallic frame.

4. The cage of claim 1, wherein the locking bar spans an entire length of the second forward facing surface of the metallic frame.

5. The cage of claim 1, wherein the metallic frame includes the back wall, the top wall, the bottom wall, and the two side walls to shield the one or more gas containing tanks from outdoor, environmental elements, the one or more gas containing tank resting on one or more shelves for displaying the one or more gas containing tanks proximate a retail store.

6. The cage of claim 1, wherein the top corner portion and the bottom corner portion of the pivotable door is reinforced by the locking bar when the locking bar is in the locking position.

7. A method of securely storing gas-containing tanks comprising:

providing a metallic frame having a first side wall, a second side wall, a top wall, and a bottom wall each being fixed together to form a solid metallic frame, the metallic frame including a plurality of openings that provide visual access to an interior of the metallic frame, the interior of the metallic frame configured to house one or more gas containing tanks, the metallic frame including a first forward facing surface at a first side of the metallic frame and being adjacent to the first side wall, and a second forward facing surface at a second side of the metallic frame and being adjacent to the second side wall;

operably attaching a pivotable door to the metallic frame proximate the first side of the metallic frame, the pivotable door engaging the first forward facing surface and the second forward facing surface when in a closed position, the pivotable door having a top corner portion, a bottom corner portion, and an edge surface, the edge surface of the pivotable door being proximate to the second forward facing surface of the metallic frame; and hingedly attaching a locking bar to the metallic frame proximate the second side of the metallic frame, the locking bar having a first body portion substantially perpendicular to a second body portion, the first body portion having a first surface and the second body portion having a second surface, the first surface having a width corresponding to a thickness of the pivotable door, the locking bar including a locking handle portion, wherein the locking handle portion cooperates with a handle of the pivotable door to lock the locking bar in a locking position;

wherein, the first surface of the locking bar covers the edge surface of the pivotable door when the pivotable door is in the closed position, and the second surface at least one of covers and engages the top corner portion and the bottom corner portion of the pivotable door when the pivotable door is in the closed position and the locking bar is in the locking position.

8. The method of claim 7, wherein operably attaching the pivotable door to the metallic frame includes one or more hinges located on the first forward facing surface of the metallic frame.

9. The method of claim 7, wherein hingedly attaching the locking bar to the metallic frame includes one or more hinges located on the second forward facing surface of the metallic frame.

10. The method of claim 7, wherein the locking bar spans an entire length of the second forward facing surface of the metallic frame.

11. The method of claim 7, wherein the metallic frame shields the one or more gas containing tanks from outdoor, environmental elements, the one or more gas containing tanks resting on one or more shelves for displaying the one or more gas containing tanks proximate a retail store, further wherein the top corner and the bottom corner of the pivotable door is reinforced by the locking bar when the locking bar is in the locking position.

* * * * *